United States Patent [19]

Moynihan et al.

[11] 4,200,335

[45] Apr. 29, 1980

[54] GAUGING APPARATUS AND METHOD, PARTICULARLY FOR CONTROLLING MINING BY A MINING MACHINE

[75] Inventors: Daniel J. Moynihan, Belleville; John A. L. Campbell, Mascoutah, both of Ill.

[73] Assignee: Peabody Coal Company, St. Louis, Mo.

[21] Appl. No.: 934,998

[22] Filed: Aug. 18, 1978

[51] Int. Cl.[2] ..... E21C 35/04; E21C 41/04

[52] U.S. Cl. ..... 299/1; 299/10; 299/76

[58] Field of Search ..... 299/1, 10, 75, 76

[56] References Cited

U.S. PATENT DOCUMENTS

| | | | |
|---|---|---|---|
| 2,756,038 | 7/1956 | Barrett | 299/75 |
| 2,777,102 | 1/1957 | Barrett | 299/75 |
| 3,922,015 | 12/1973 | Poundstone | 299/1 |
| 4,108,494 | 8/1978 | Kogler | 299/1 |

*Primary Examiner*—Ernest R. Purser

*Attorney, Agent, or Firm*—Senniger, Powers, Leavitt and Roedel

[57] ABSTRACT

Apparatus for and method of controlling the mining by a mining machine of a seam of material (e.g., coal) overlying or underlying a stratum of undesired material (e.g., clay) to reduce the quantity of undesired material mined with the desired material, the machine comprising a cutter movable up and down and adapted to cut down into a seam of coal on being lowered. The control apparatus comprises a first electrical signal constituting a slow-down signal adapted to be automatically operated to signal when the cutter has cut down into a seam of desired material generally to a predetermined depth short of the interface between the seam and the underlying stratum for slowing down the cutting rate as the cutter approaches the interface, and a second electrical signal adapted to be automatically operated subsequent to the first signal for signalling when the cutter has cut down through the seam to the interface for stopping the cutting operation, thereby to avoid mining undesired material with the desired material. Similar signalling may be provided on an upward cut to avoid cutting into the overlying stratum.

42 Claims, 14 Drawing Figures

GAUGING APPARATUS AND METHOD, PARTICULARLY FOR CONTROLLING MINING BY A MINING MACHINE

BACKGROUND OF THE INVENTION

This invention relates in general to apparatus for and a method of controlling the movement of a movable element of a machine, such as a boom of a mining machine, and more particularly to apparatus for and a method of controlling the downward or upward cut by a mining machine in a seam of material to be mined (coal, for example) overlying or underlying a stratum of undesired material (clay, for example) to reduce the quantity of undesired material mined with the desired material. It is especially concerned with apparatus for and a method of controlling the cutting by a continuous miner of the type generally comprising a carriage, a cutter boom mounted on the carriage for up-and-down movement relative to the carriage, and a cutter carried by the boom adapted to cut down into the seam of desired material on lowering the boom.

Heretofore, operators of mining machines and particularly machines of the type known as continuous miners, have used a variety of methods to determine when the machine is cutting or "shearing" beyond the limits of the seam of the desired material (coal, ore) and into the undesired bottom (or top) material (e.g., clay). Some operators, for example, have relied on their vision to alert them, a change in the color of the cuttings indicating that the miner is cutting beyond the seam of the desired material. Others have depended on their sense of touch, i.e., on their ability to "feel" a difference in the operation of the miner when it begins to cut into undesired material below or above the seam of the desired material, or on their sense of hearing to hear the difference. However, all these methods have proven to be unsatisfactory for confining the cut of the mining machine to the seam of the desired material. They generally result in an undue amount of undesired material (e.g., clay) being mined with the desired material (e.g., coal). This, in turn, has caused considerable waste of mining time and effort as well an increased costs for preparation (cleaning) of the desired material and waste disposal.

Moreover, the "vision" test is wholly ineffective after cutting or sumping into a coal seam (for example) a relatively short distance (10–20 feet) since all visual perceptions necessary for guiding the miner are lost after that distance. It has been necessary in the past for the mining machine (e.g., the continuous miner) constantly to be withdrawn from one place and moved to another (known as "tramming") while the one place is shored up, cleaned and otherwise prepared for further mining. The excessive amount of time spent in tramming due to the inability to make cuts of a greater distance has necessarily reduced the amount of time available for mining coal. Penetration deeper than 10–20 feet (e.g., 30–40 feet) into a seam is possible utilizing remote control of the mining machine, but in such mode of operation the operator is too far back from the machine to see, and, being off the machine, has no sense of touch as to the operation.

SUMMARY OF THE INVENTION

Among the several objects of this invention may be noted the provision of an apparatus and a method which generally involve the gauging of the movement of the movable cutting element, such as the cutter boom of a mining machine, to determine its positon and which more particularly provide for controlling the mining by a mining machine, e.g., a continuous miner, of a seam of coal or other desired material overlying a stratum of undesired bottom material, such as clay, to reduce the quantity of bottom material mined with the coal; the provision of such apparatus and method for signalling when the cutter of the machine has cut down into a seam of coal generally to a predetermined depth short of the interface between the seam and the underlying stratum for slowing down the cutting rate as the cutter approaches the interface, and signalling when the cutter has cut down through the seam of coal to the interface for stopping the cutting operation thereby to avoid mining bottom material with the coal; the provision of such apparatus and method for guiding a continuous miner to cut into a coal seam for substantially greater distances thereby to decrease the miner's tramming time; and the provision of such apparatus and method which are safe, reliable and economical in operation, and easy to use.

In general, the apparatus and method of this invention involve the controlling of the movement of a movable cutting element, of a mining or excavating apparatus such as a cutter boom of a mining machine, to a predetermined elevation at which it is desired to stop cutting, such as the interface of a seam of coal or other material and an underlying or overlying stratum, with a slow-down signal being given when the movable element has moved to a preliminary predetermined elevation (the "slow-down elevation") short of its final stopping elevation and a stop signal being given when the movable cutting element has moved to the final stopping elevation.

Other objects and features of the invention will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
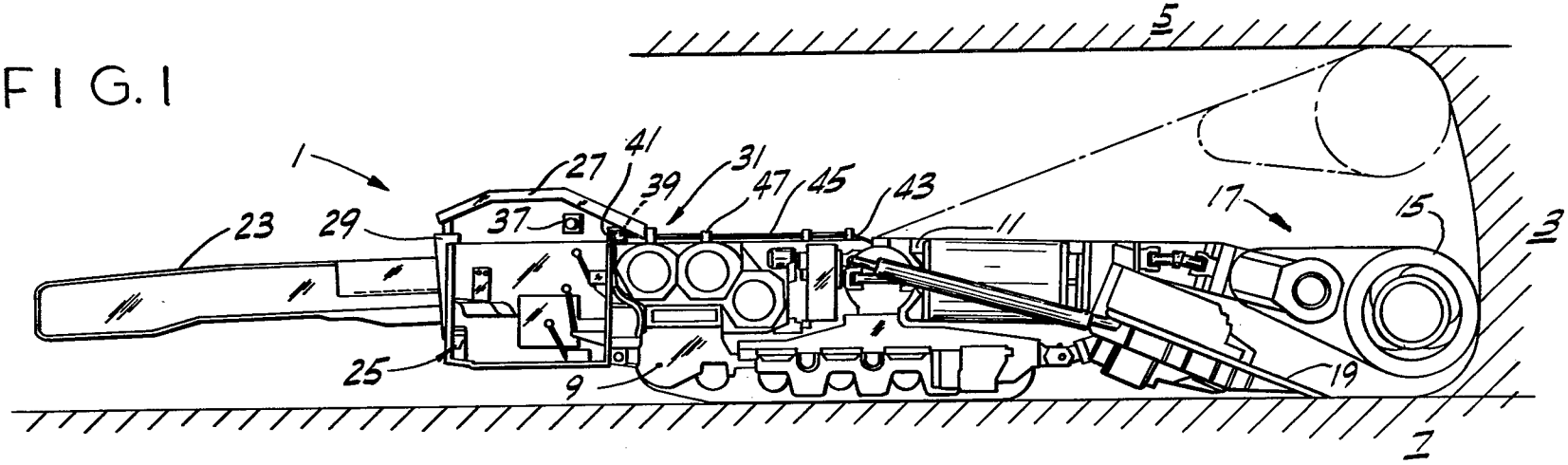
FIG. 1 is a side elevation of a mining machine, more particularly a continuous miner, having control apparatus of this invention installed thereon.
Figure 2:
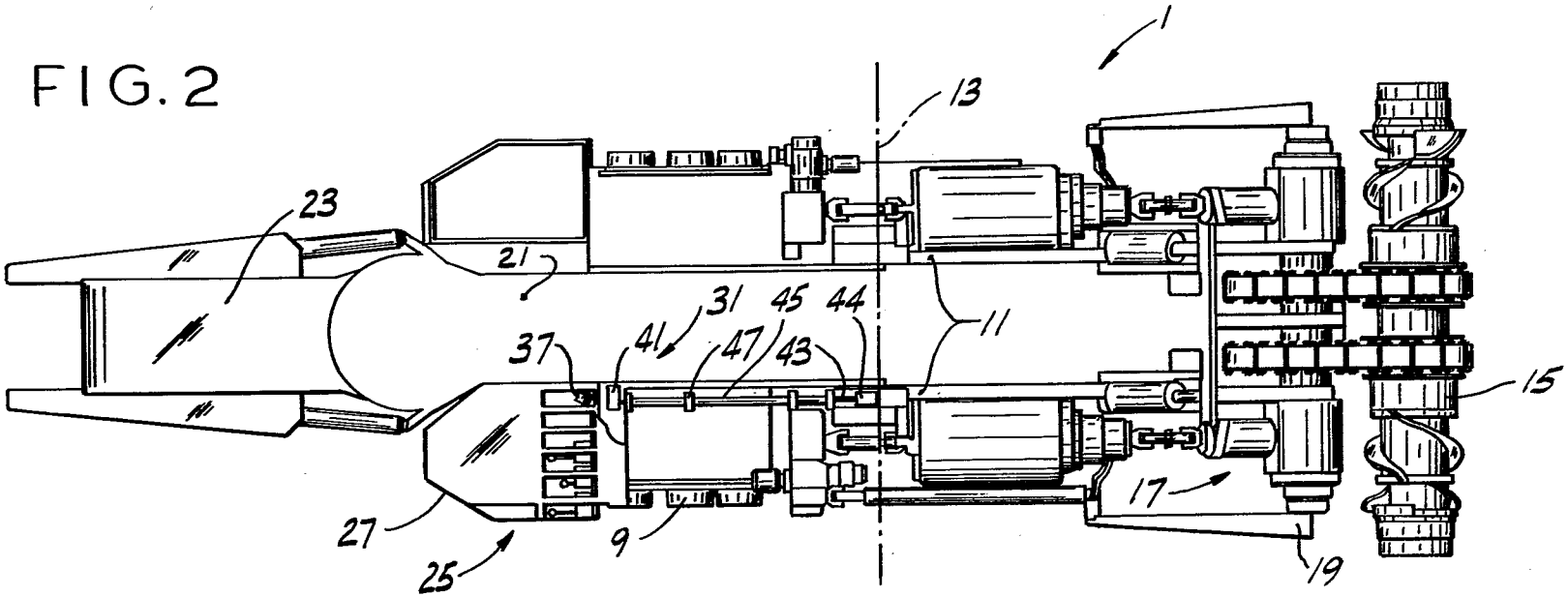
FIG. 2 is a plan of FIG. 1.

The invention is herein illustrated as applied to a mining machine of the type referred to as a continuous miner. Referring to FIGS. 1 and 2 of the drawings, such a machine, designated generally by the reference numeral 1, is shown in position to mine a seam 3 of coal underlying a stratum 5 of top material (typically shale) and overlying a stratum 7 of bottom material such as clay. The miner 1 is of a conventional type, generally comprising a carriage 9, a cutter boom 11 pivotally mounted on the carriage for up-and-down swinging movement relative to the carriage about a horizontal axis at 13 extending transversely of the carriage, and a cylindrical cutter or cutting head 15 carried by the boom at the forward end of the boom (its right end as shown in FIGS. 1 and 2). This cutting head 15 is rotatable about its axis by conventional power means generally indicated at 17 and when raised to a position adjacent the roof of the mine (as shown in phantom in FIG. 1) is adapted to "sump" (cut forward) into the coal seam 3 and "shear" (cut down) on lowering the boom 11. At the forward end of the carriage 9 generally beneath the cutting head 15 is a gathering head 19 for gathering loose cuttings on the mine floor and for moving them rearwardly toward a conveyor 21 which extends the length of the miner for transporting the mined material to a discharge section 23 at the rear of the machine. The controls for the continuous miner are located in a cab 25 immediately forward of section 23 at the right side of the miner, the cab having a roof 27 pivoted at its forward end on the carriage 9 for swinging between open and closed positions via a hydraulic cylinder 29.

Figure 6:
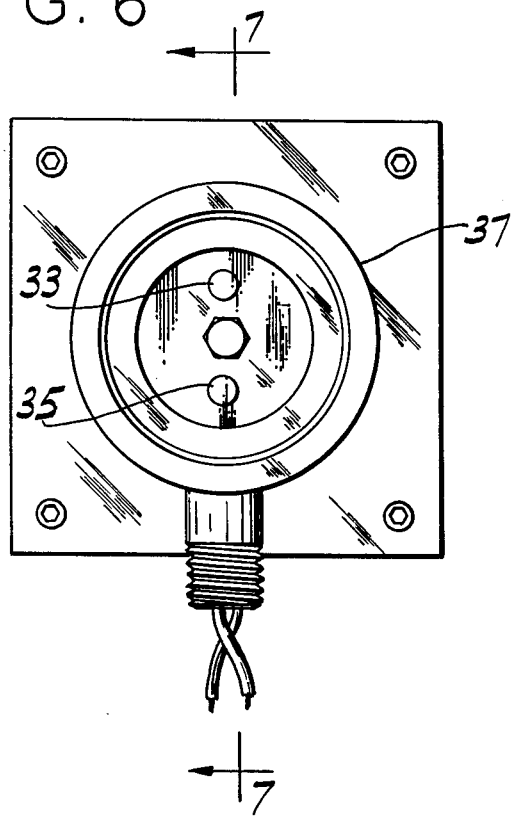
FIG. 6 is a view of a unit including a pair of electrical signal lamps adapted to be operated by actuation of the switches shown in FIG. 3 for signalling the depth of a cutter of the machine in a coal seam.
Figure 7:
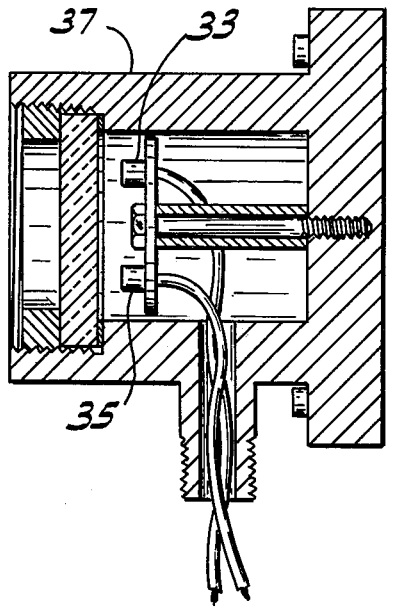
FIG. 7 is a section on line 7—7 of FIG. 6.
Figure 8:
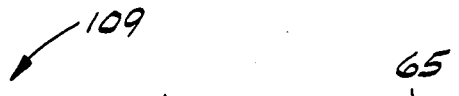
FIG. 8 is a wiring diagram.

Apparatus of this invention for controlling the downward cut of cutting head 15 to reduce the quantity of bottom material 7 mined with the coal is shown installed on the miner and is indicated generally at 31. Referring to FIGS. 6–8, the apparatus includes a pair of electric signals for alerting the operator as to the elevation (depth) of the cutting head 15 in the coal seam. These signals are constituted by two lamps 33 and 35 (see FIG. 6) of different color mounted in a housing 37 on the side wall of the cab 25 in a position preferably forward and above the working position of the operator as shown best in FIG. 1. In that location, the lamps do not interfere with the operator's vision or control of the miner and yet are within his peripheral vision for allowing him readily to determine when they are illuminated. The first of these lamps, the upper lamp 33, is preferably amber in color and provides a slow-down signal for visually signalling when the cutting head 15 has cut down into the seam of coal 3 generally to a preliminary predetermined "slow-down" elevation (e.g., one foot) short of the interface between the coal seam 3 and the underlying stratum 7 to warn the operator to slow down the cutting rate of the cutting head as it approaches the interface. The second (lower) lamp 35, preferably red in color, is a stop signal for signalling when the cutting head 15 has cut down through the seam of coal to the interface and alerting the operator to stop the cutting operation of the miner at the interface (the predetermined final elevation) thereby to avoid mining bottom material with the coal.

Operation of the signal lamps 33,35 is controlled by switch means, generally indicated at 39 (see FIG. 3), in a housing 41 mounted at the front of the cab directly under the roof (FIG. 1). This switch means 39 is adapted to be engaged for operating lamps 33,35 by a switch-operating means, generally designated 42, on a cable 43 in the housing and extending outwardly therefrom through the front of the cab and forwardly along the carriage 9 at the right side of the conveyor 21 to a connection at 44 with the back end of the boom 11. The cable is protected by a sheath 45 and is mounted atop the carriage by brackets 47 or other suitable means, the cable moving axially in the sheath on movement of the boom. The cable 43 is adapted to be pulled forwardly by the boom 11 when the boom is lowered for a downward shear of the cutting head 15, and pulled rearwardly by a cable take-up means, generally designated 49, in the housing 41 when the boom is raised. As will appear, the switch-operating means 42 on the cable is engageable with the switch means 39 on lowering the boom for successively lighting the signal lamps 33,35 to alert the operator of the continuous miner 1 as to the depth of the cutting head 15 in the coal seam 3.

Figure 3:
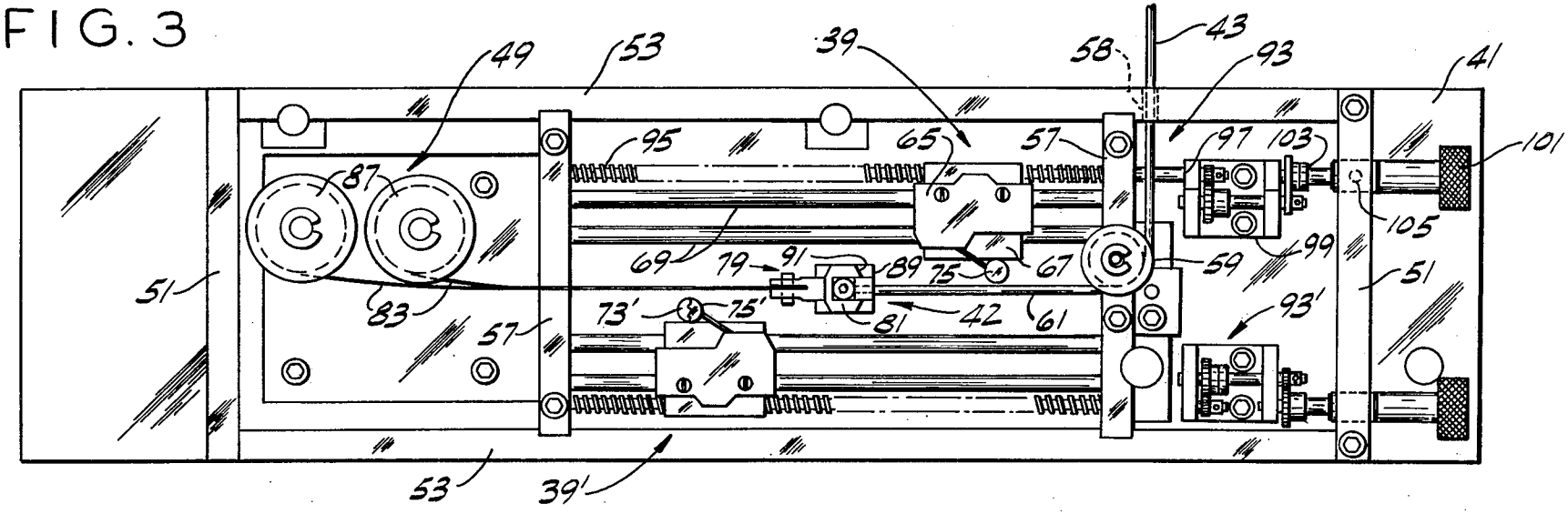
FIG. 3 is an enlarged fragment of FIG. 2 showing details including switches adapted to be successively actuated by a switch-operating means.
Figure 5:
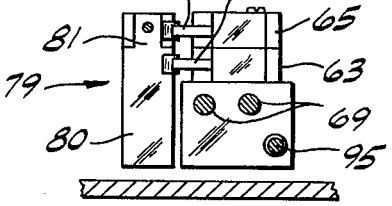
FIG. 5 is a vertical section on line 5—5 of FIG. 4 showing the switch-operating means.
Figure 4:
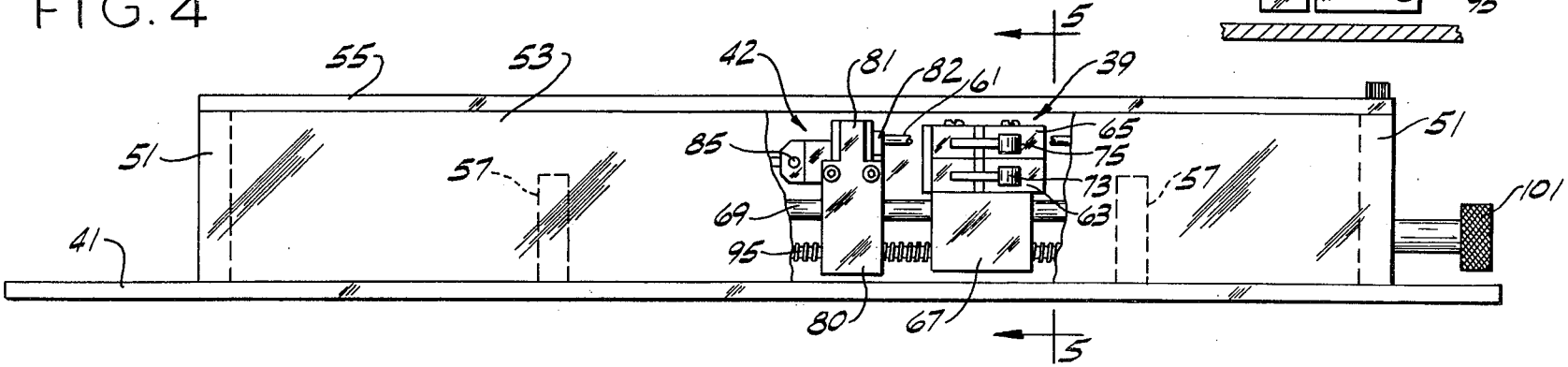
FIG. 4 is a side elevation of FIG. 3, with parts broken away to show further details.

As shown in FIGS. 3 and 4, the housing 41 for switch means 39 is generally rectangular in shape, having end walls 51, side walls 53, a top 55 (removed in FIG. 3) and a pair of partitions 57 extending transversely between the side walls. The cable 43 enters the housing through a hole 58 in that side wall 53 of the housing which is toward the front as the housing is installed in the cab as shown in FIGS. 1 and 2, is trained around a pulley 59 mounted on the right-hand partition 57 and then extends lengthwise of the housing generally in the central vertical longitudinal plane of the housing toward take-up means 49, a straight reach 61 of cable thus being established between pulley 59 and the take-up means. The switch means 39 is mounted alongside this reach 61 between the front side wall 53 of the housing and the cable, and includes a pair of switches 63,65 which control the first and second signal lamps 33,35, respectively. These switches are carried by a carriage 67 mounted for sliding movement on a pair of guide rods 69 extending parallel to cable reach 61 generally below the cable and having opposite ends supported in partitions 57. The switches 63,65 have respective actuators 73,75 thereon projecting toward the center of the housing for engagement by the switch-operating means 42 on the cable.

The switch-operating means 42 is at the tail end of the cable and is movable with the cable (on movement of the boom 11) lengthwise of the housing between the left and right partitions 57 for successively engaging the switch actuators 73,75 to operate the switches 63,65. This means 42 comprises a generally rectangular-shaped tripping block, generally indicated at 79, having a lower portion 80 and an upper portion 81 of reduced size to which the cable 43 is secured at 82. The cable take-up means 49 comprises two steel tapes 83 of the type which tend to wind themselves up and provide a constant spring force. These are pinned at 85 to the opposite side of the upper portion 81 and extend side by side therefrom to tape housing 87 at the left end of the housing 41.

On movement of the cable and the tripping block 79 thereon to the right (as when the boom 11 is lowered during a downward shear of cutting head 15) the lower portion 80 of the block is adapted to engage at 89 the lower actuator 73 when the cutting head 15 has cut down into the coal seam 3 generally to a predetermined depth (one foot, for example) short of the interface between the coal seam and the underlying stratum 7. This causes the amber signal lamp 33 to illuminate for alerting the operator to slow down the cutting rate of the cutting head. Continued downward movement of the cutting head causes the tripping block to travel further to the right for engagement of the upper portion 81 of the block at 91 with the upper actuator 75 when the cutter has cut down through the coal to the interface, thus causing the red stop signal lamp 35 to illuminate for signalling the operator to stop the cutting operation to avoid mining bottom material with the coal.

To adjust the control apparatus 31 for different or changing coal-seam elevations, means indicated generally at 93 is provided for moving the carriage 67 along the guide rods 69 to adjust the position of the switch actuators 73,75 relative to the tripping block 79 on the cable. In this regard, increasing the distance between the tripping block and the actuators allows the cutting head 15 to cut to a greater depth (for pitching coal seams) before the actuators are tripped (via block 79) and the signal lamps 33,35 operated. Decreasing this relative distance effects the opposite result for opposite pitching coal seams. The adjustment means 93 comprises a horizontal lead screw 95 parallel to and below guide rods 69 and extending threadably through the carriage 67. This screw 95 is journaled in suitable bearings (not shown) in the left and right partitions 57 and extends from the latter to a connection at 97 at the output of a gear train 99 mounted adjacent the right end wall 51 of the housing. A knurled adjustment knob 101 rotatably mounted in end wall 51 and connected at 103 to the input of the gear train 99 provides means for turning the lead screw 95 thereby to traverse the carriage 67 along the guide rods 69. A detent indicated at 105 on the knob releasably holds the latter in position every half-turn.

To adjust the control apparatus 31 for mining a pitching coal seam, for example, knob 101 is turned in a clockwise direction to adjust the carriage 67 to the right along the guide rods 69 the appropriate distance. This adjustment allows the cutting head 15 to cut down to a greater depth in the pitching coal seam before the switch actuators 73,75 are tripped by tripping block 79 for operating the switches to illuminate the signal lamps 33,35 in the cab. For example, with the gear train 99 shown, a one-half turn of knob 101 moves the carriage 67 along the rods the distance required to change the cutting-head elevation at which the lights come on by about one inch. Detent 105 on the knob facilitates adjustment and holds the knob in its adjusted position.

As shown in FIG. 3, a second switch means 39' identical in structure to switch means 39 described above may also be provided at the opposite side of the switch operating means 42 between the rear side wall 53 and the cable toward the left end of the housing 41 for controlling the upward cut of cutting head 15 to reduce the amount of top material mined with coal. As illustrated, switch means 39' includes a pair of switch actuators 73',75' positioned for successive actuation by tripping block 79 upon movement of the latter to the left (as when the boom 11 and cutting head 15 are raised during a top sump). Adjustment means also identical to that described above is generally indicated at 93' for adjusting the relative distance between the actuators 73',75' and the block 79 for different coal-seam thicknesses. It should be understood that these switch and adjustment means 39',93' are optional and not necessary for the proper functioning of this invention.

FIG. 8 shows how signal lamps 33 and 35 are interconnected with the switches 63 and 65 for being energized from an a.c. power source indicated at L1 and L2 via spark-preventing means indicated at 109, such as a GEMS ISC Safe-Pak means, the arrangement being such that when switch 63 closes, the amber lamp 33 is energized and when switch 65 closes, the red lamp 65 is energized.

After maneuvering the continuous miner to a position adjacent a generally vertical face of the coal seam 3 where the cutting operation is to be started (FIG. 1), the operator lowers the cutting head 15 into engagement with the surface of the underlying stratum (i.e., the interface between the coal seam 3 and the bottom material 7, which interface has been previously exposed). The elevation of the cutting head 15 in this position is the elevation below which the miner 1 should not cut to avoid mining bottom material. The control apparatus 31 is then set for this elevation by turning the adjustment knob 101 to move the carriage 67 along the guide rods 69 until the switch actuators 73,75 are successively engaged by the tripping block 79 for closing the switches 63,65 to successively energize the amber signal lamp 33 (the slow-down signal) and the red lamp (the stop signal). After setting the control apparatus 31, the operator is ready to begin mining. On raising the boom 11 and cutting head 15 for a sump, the cable 43 secured to the back end of the boom is pulled rearwardly in its sheath 45 (by spring reels 87) and the tripping block 79 on the cable travels to the left (as viewed in FIGS. 3 and 4) relative to the switch actuators 73,75 for disengaging the latter and deenergizing the signal lamps. Then, after sumping, on shearing down into the coal seam, the cable is pulled forwardly by the boom and the tripping block 79 travels to the right in housing 41 until the lower portion 80 of the block strikes the lower actuator 73 for illuminating the amber signal lamp 33 to signal the operator that the cutting head 15 has cut down into the coal seam generally to a predetermined depth (about one foot) short of the interface so that he can slow down the cutting rate of the cutting head as it approaches the interface. On further lowering of the boom 11, the tripping block moves further to the right until the upper switch actuator 75 is engaged by the upper portion 81 of the block for illuminating the red lamp 35 to alert the operator that the cutting head has cut down through the seam of coal to the interface and that the cutting operation should be stopped to avoid mining bottom material with the coal.

Variations in thickness or elevation of the coal seam 3 may require readjustment of the control apparatus 31. This can be readily accomplished by readjusting the position of the switch actuators 73,75 relative to the tripping block 79 on the cable 43 via the adjustment knob 101 as above described.

Operation and adjustment of the apparatus 31 for controlling the upward cut of the continuous miner to reduce the quantity of top material mined with the coal is accomplished in essentially the same manner as described above by means of switch means 39' and adjustment means 93'.

The apparatus is also useful, for example, in making a cut in a seam of lesser height than the seam thickness, e.g., making a cut 8 feet high in a seam 13 feet thick.

From the above, it will appear that in respect to mining operations the invention involves the method of controlling the mining by a mining machine of a seam of material, such as coal, comprising the steps of gauging the depth of the cutting head 15 of the continuous miner 1 in the seam as the cutting head moves down in the seam 3; operating a first signal (such as signal lamp 33) constituting a slow-down signal when the cutting head has cut down into the seam to a depth which is generally a predetermined distance (e.g., one foot) from the interface between the seam 3 and the underlying stratum 7; and slowing down the cutting rate of the cutting head in response to the slow-down signal while continuing the gauging of the depth of the head in the seam. The method futher includes the steps of operating a second signal (signal lamp 35, for example, which as stated earlier, is preferably of a different color than the slow-down signal lamp 33) constituting a stop signal when the cutting head 15 has cut down through the entire depth of the seam to the interface, and stopping the cutting operation in response to the stop signal to avoid mining undesired material with the desired material. Operation of the two signals may be accomplished by the control apparatus 31 described above although other means may also be suitable.

In accordance with the method of this invention, the gauging of the depth of the seam 3 is initially adjusted generally by lowering the cutting head 15 into engagement with an exposed surface of the underlying stratum 7 (i.e., the interface between the seam and bottom material) adjacent a face of the seam where the cutting operation is to be started. The stop signal (lamp 35) is then set for operation at that position for signalling to the operator during subsequent shearing operations that he has cut down through the seam to the interface. The setting of the stop signal may be accomplished by means of the apparatus 31 in the manner previously described, and may be reset as needed.

It will be readily observed from the foregoing that the control apparatus 31 and method of this invention enable the machine operator to control the operation for reducing the quantity of undesired (e.g., bottom) material mined with the desired material (e.g., coal). Also, this apparatus and method provide for guidance of the miner to cut into a seam for substantially greater distances than heretofore possible since the operator does not have to rely on his view of the cutting operation or his sense of touch to determine when the machine has cut through the seam to the interface between the seam and undesired material. This, of course, decreases the machine's tramming time and thus increases the amount of time available for mining. Moreover, both the apparatus and method of controlling the machine are safe, reliable and economical in operation and easy to use. With the system of this invention, the operator quickly learns how to compensate for variations in a seam, by backing out and readjusting.

Figure 9:
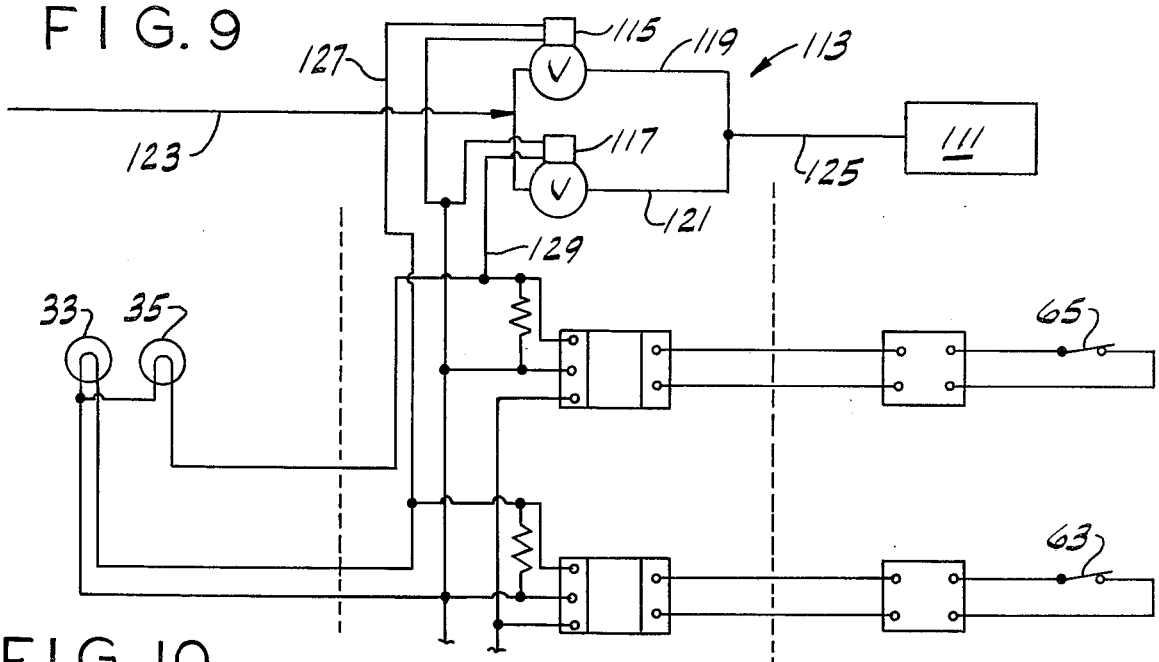
FIG. 9 is a wiring diagram showing a modification.

FIG. 9 illustrates a modification adapted automatically to slow down the rate of movement of the cutter 15 in response to the slow-down signal from the switch 63, and to stop the cutter at the predetermined final elevation in response to the stop signal from the second switch 65. With regard to this modification, the cutter boom 11 is adapted to be swung up and down by hydraulically powered means indicated generally at 111 in FIG. 9, with means indicated generally at 113 for delivering hydraulic fluid under pressure thereto from a suitable source, such as a hydraulic pump (not shown) on the carriage or vehicle 9. Means 113 includes solenoid valve means comprising a pair of solenoid valves 115 and 117 connected in branch lines 119 and 121 receiving hydraulic fluid from the source via a line 123 and adapted to deliver the fluid to means 111 via a line 125. The arrangement is such that with both valves 115 and 117 open full fluid flow is supplied to means 111 for operation of the boom 11 at its normal rate of movement. With valve 115 closed and valve 117 open, the delivery of hydraulic fluid to means 111 is reduced thereby to slow down the rate of movement of the boom, and with both valves 115 and 117 closed, the delivery of hydraulic fluid to means 111 is cut off to stop the boom. Valve 115 is interconnected as indicated at 127 in the same circuit as shown in FIG. 8 for being closed on actuation of switch 63 to generate the slow-down signal, and valve 117 is interconnected as indicated at 129 in the circuit for being closed on actuation of switch 65 to generate the stop signal.

Figure 10:
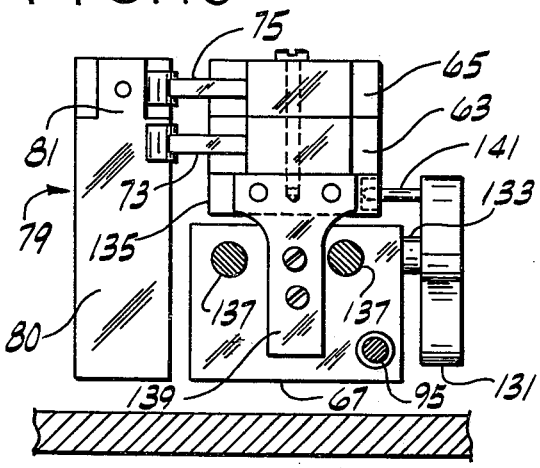
FIGS. 10 and 11 are views showing another modification, FIG. 10 being an end view of FIG. 11.
Figure 11:
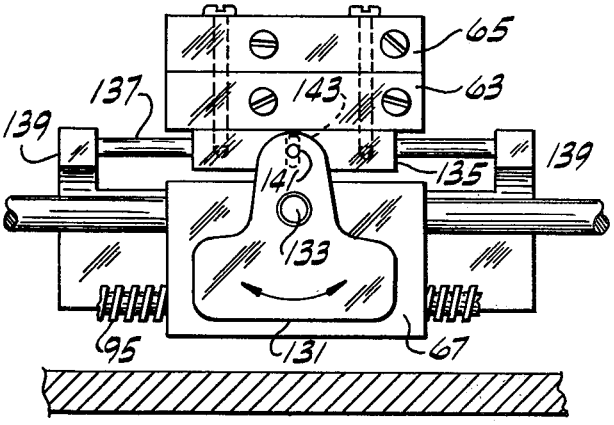

FIGS. 10 and 11 illustrate a modification for automatically adjusting the switches 63 and 65 in response to a change in attitude of the body of the mining machine, i.e., a change in the fore-and-aft attitude of the body, as may occur during a cutting operation if the body is not stabilized. In this regard, it will be understood that mining machines such as herein illustrated are generally so constructed that the body of the machine, on which boom 11 is pivoted (and which includes the cab 25), is itself so mounted on the tractor part of the machine that it may tend to tilt in fore-and-aft direction on the tractor part of the machine due to the reaction from the cutting operation. This may be taken care of by using a stabilizing jack at the rear of the body, but often it is not. When it is not, any tilting of the body, with resultant change in the level of the pivot axis of the boom, causes a change in the slow-down and stopping elevations, unless compensated for. The mechanism shown in FIGS. 9 and 10 effects automatic adjustment of switches 63 and 65 for such compensation.

The modification of FIGS. 10 and 11 involves the addition to the mechanism in the housing 41 of means for automatically adjusting the switches 63 and 65 relative to the carriage 67 (which remains manually adjustable by means of the screw 95) in response to a change in the fore-and-aft attitude of the body of the machine. In the use of this modification, the housing 41 is mounted to extend longitudinally of the body of the machine, as distinguished from its lateral positioning shown in FIGS. 1 and 2. The automatic adjustment means comprises a pendulum 131 pivoted as indicated at 133 on the carriage 67 for swinging movement relative to the carriage 67 on a horizontal axis which extends transverse to the machine. Thus, if the body of the machine tilts up at the front, the upper end of the pendulum in effect moves forward relative to the carriage, and vice versa (the pendulum remains vertical). The switches 63 and 65 are mounted on a slider 135 slidable on a pair of guide rods 137 extending longitudinally with respect to the machine between supports 139 (which may be T-shaped, as shown) extending up from the carriage 67 at its ends. A pin 141 extends from the upper end of the pendulum into a slot 143 in the slider for effecting control over the position on the slider and hence the switches 63 and 65 by the pendulum. The arrangement is such that with the body of the machine (and housing 41) horizontal in fore-and-aft direction, the slider 135 and switches 63 and 65 occupy a centered position relative to the carriage 67. If the body tilts up toward the forward end of the machine, the slider and switches move forward on rods 137, and if the body tilts down toward the forward end of the machine, the slider and switches move back on the rods.

Figure 12:
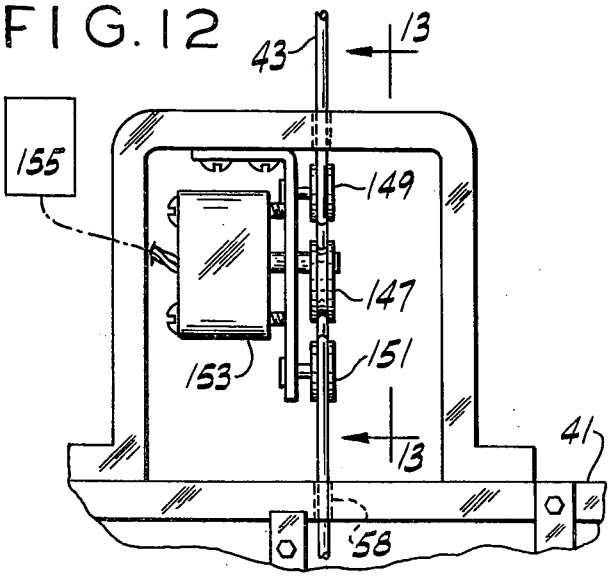
FIGS. 12 and 13 are views showing another modification, FIG. 13 being in section on line 13—13 of FIG. 12.
Figure 13:
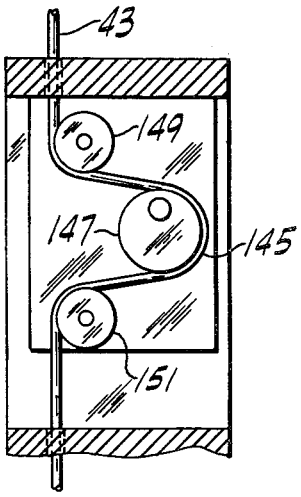

FIGS. 12 and 13 illustrate another modification for automatically compensating for change in attitude of the body of the machine by adjustment of the cable 43 (as distinguished from adjustment of the switches 63 and 65). In this modification, the cable 43, where it enters the housing 41 is guided to form a loop 145 around an eccentric 147 by means of a pair of pulleys 149 and 151. The eccentric is adapted to be rotated to take up cable in the loop or let off cable from the loop by means of a servo motor 153 controlled by a means 155 such as an inertial guidance device for sensing the attitude of the body of the machine.

Device 155 may also be a feedback device for interface proof testing such as a torque drill, pressure-sensitive bit or the like for sensing the coal interface. When means 155 receives a positive signal from the proof test, prior to activation of the stop signal, device 155 enerqizes servo motor 153 to incrementally take up more cable, causing the stop signal to activate sooner. The new stopping point elevation now becomes the elevation at which the stop point signal will activate on the next shear cycle. When the proof test is negative, cable is let out and the opposite effect is achieved. Taking up or letting off cable from the loop changes the initial position of the switch-actuating block 79 on the cable relative to the switches 63 and 65.

Apparatus of this invention as above described may be regarded as involving a movable cutting element, e.g., the cutter boom 11 and means for controlling the movement of the movable cutting element adapted to be pre-set (by adjustment of the carriage 67 along rods 69 to adjust the position of the switch actuators 73,75 relative to the tripping block 79 on cable 43), comprising slow-down signal means and stop signal means. The slow-down signal means in one instance (FIGS. 1–8) comprises switch 63 adapted to generate a warning signal when actuated and lamp 33; in another (FIG. 9) it comprises switch 63 and valve 115. The stop signal means in the one instance comprises switch 65, adapted to generate a stop signal when actuated, and lamp 35; in the other it comprises switch 65 and valve 117. The slow-down signal means is pre-settable (by the adjustment as described) in accordance with the elevation or depth of cut at which the slow-down signal is to be given for signalling when the cutting element has moved to this elevation (which may be referred to as the preliminary predetermined elevation). The stop signal means is pre-settable (by the adjustment as described) in accordance with the elevation at which cutting is to be stopped (which may be referred to as the predetermined final elevation). In pre-setting the stopping elevation, which may also be termed the stopping horizon (the term "horizon" here being used in its geological sense) the stopping elevation is in effect held in memory for stopping the cutting element at the stopping elevation or horizon. Setting the latter also sets the preliminary slow-down elevation and in effect holds it in memory for the slow-down signal when the cutting element reaches the slow-down elevation.

It will be understood that, in referring to the cutting element as being stopped at the final or stopping elevation, it is intended to cover operation in which movement of the cutting element in cutting direction is stopped at the final or stopping elevation and then reversed (the stopping being transitory).

Figure 14:
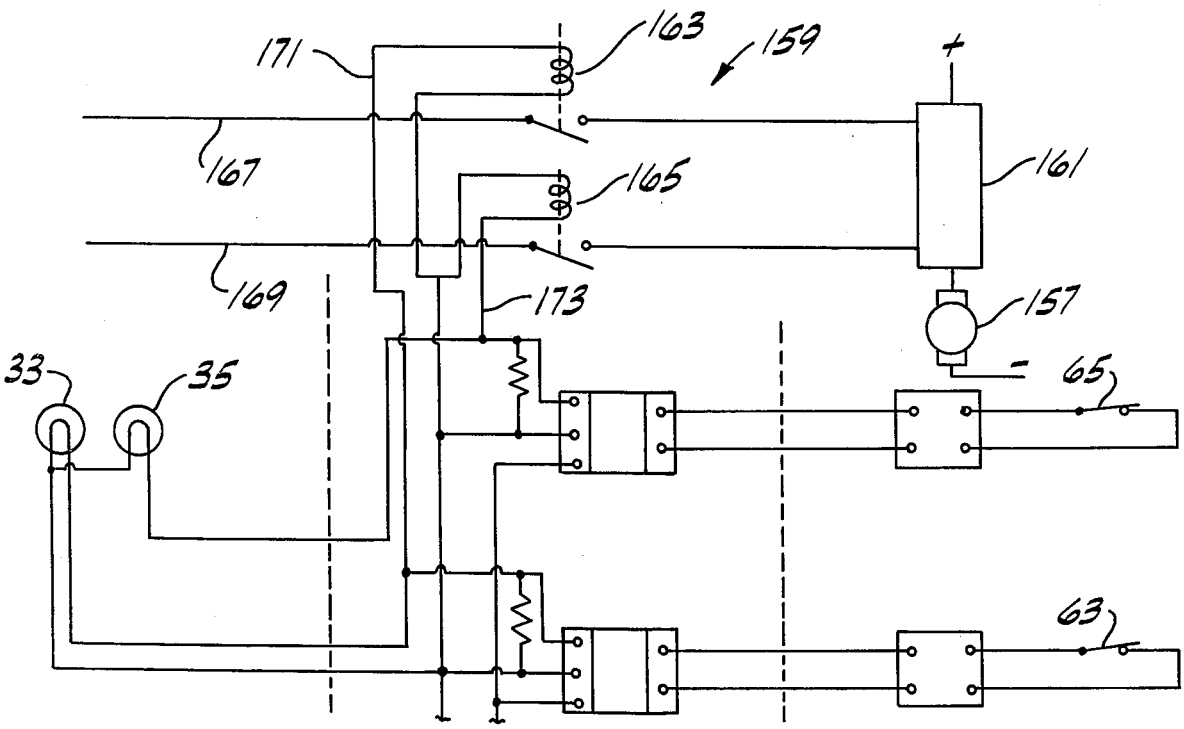
FIG. 14 is a wiring diagram showing another modification.

FIG. 14 illustrates another modification adapted automatically to slow down the rate of movement of the cutter 15 in response to the slow-down signal from the switch 63, and to stop the cutter at the predetermined final elevation in response to the stop signal from the second switch 65. With regard to this modification, the cutter boom 11 is adapted to be swung up and down by a variable-speed electric motor indicated generally at 157 in FIG. 14, with control means indicated generally at 159 for the motor. This control means comprises a motor speed control 161 and a pair of relays 163 and 165 connected in lines 167 and 169 leading to the control 161. The arrangement is such that with both relays 163 and 165 energized, control 161 effects operation of the motor 157 for operation of the boom 11 at its normal rate of movement. With relay 163 energized and relay 165 deenergized, control 161 effects operation of motor 157 at reduced speed, thereby to slow down the rate of movement of the boom. With both relays deenergized, control 161 stops the motor to stop the boom. Relay 163 is interconnected as indicated at 171 in the same circuit as shown in FIG. 8 for being energized on actuation of switch 63 to generate the slow-down signal, and relay 165 is interconnected as indicated at 173 in the circuit for being energized on actuation of switch 65 to generate the stop signal.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for mining or excavating having a movable cutting element movable to different elevations and means for controlling the movement of said movable cutting element adapted to be pre-set to establish a predetermined final elevation at which the cutting element, in making a cut, is to be stopped, and to establish a predetermined preliminary elevation, in advance of the final elevation, at which the movement of the movable cutting element is to be slowed down, said apparatus comprising:

slow-down signal means pre-settable in accordance with said preliminary elevation for signalling when the movable cutting element, in making a cut, has moved to said preliminary elevation short of the said final elevation at which it is to be stopped;

stop signal means pre-settable in accordance with said final elevation for signalling when the movable cutting element has moved to its said predetermined final elevation for stopping the movable cutting element at said predetermined final elevation;

said slow-down signal means including first means for generating a slow-down signal;

said stop signal means including second means for generating a stop signal; and means operable by said movable cutting element for actuating said first signal generating means for actuating the slow-down signal means when the movable cutting element has moved to the said preliminary elevation and for actuating said second signal generating means for actuating the stop signal means when the movable cutting element has reached its said final elevation.

2. Apparatus as set forth in claim 1 having means for effecting relative adjustment of said signal generating means and said means for actuating said signal generating means to vary the setting of said preliminary and final elevations.

3. Apparatus as set forth in claim 1 having a lamp of one color controlled by said slow-down signal means and a lamp of a different color controlled by said stop signal means visually to signal the operator of the apparatus when the movable cutting element reaches the preliminary elevation and subsequently when the movable cutting apparatus reaches the final elevation.

4. Apparatus as set forth in claim 1 having means for effecting slowing down of the rate of movement of the cutting element in response to a signal from said first signal generating means and for stopping the cutting element at said final elevation in response to a signal from said second signal generating means.

5. Apparatus as set forth in claim 4 having hydraulically powered means for moving the cutting element and means for delivering hydraulic fluid thereto wherein the means for effecting the slowing down and stopping of the cutting element comprises solenoid valve means operable in response to a signal from said first signal generating means to reduce the delivery of hydraulic fluid to said hydraulically operated means and operable in response to a signal from said second signal generating means to cut off delivery of hydraulic fluid to said hydraulically operated means.

6. Apparatus as set forth in claim 4 having variable-speed electric motor means for moving the cutting element and wherein the means for effecting the slowing down and stopping of the cutting element comprises means operable in response to a signal from said first signal generating means to slow down the motor means and operable in response to a signal from said second signal generating means to stop the motor means.

7. Apparatus as set forth in claim 1 having means operable automatically in response to change in attitude of said apparatus for effecting relative adjustment of said signal generating means and said means for actuating said signal generating means to vary the setting of said warning and final elevations to compensate for said change in attitude.

8. Apparatus as set forth in claim 1 comprising mining apparatus wherein said movable cutting element is on a boom mounted for up-and-down movement on a vehicle, said boom being movable up and down for movement of the cutting element to effect cutting in a stratum toward the interface with an adjacent stratum.

9. Mining apparatus as set forth in claim 8 having means for effecting relative adjustment of said signal generating means and said means for actuating said signal generating means to vary the setting of said warning and final elevations.

10. Apparatus as set forth in claim 9 having means for sensing the interface, said adjusting means being responsive thereto.

11. Mining apparatus as set forth in claim 8 having a lamp of one color controlled by said slow-down signal means and a lamp of a different color controlled by said stop signal means visually to signal the operator of the apparatus when the movable cutting element reaches the preliminary elevation and subsequently when the movable cutting apparatus reaches the final elevation.

12. Mining apparatus as set forth in claim 8 having means for effecting slowing down of the rate of movement of the cutting element in response to a signal from said first signal generating means and for stopping the cutting element at said final elevation in response to a signal from said second signal generating means.

13. Mining apparatus as set forth in claim 8 having hydraulically powered means for moving the cutting element and means for delivering hydraulic fluid thereto wherein the means for effecting the slowing down and stopping of the cutting element comprises solenoid valve means operable in response to a signal from said first signal generating means to reduce the delivery of hydraulic fluid to said hydraulically operated means and operable in response to a signal from said second signal generating means to cut off delivery of hydraulic fluid to said hydraulically operated means.

14. Mining apparatus as set forth in claim 8 having means operable automatically in response to change in attitude of said apparatus for effecting relative adjustment of said signal generating means and said means for actuating said signal generating means to vary the setting of said preliminary and final elevations to compensate for said change in attitude.

15. Apparatus for controlling the mining by a mining machine of a seam of desired material, such as coal, overlying a stratum of undesired bottom material, such as clay, to reduce the quantity of the undesired material mined with the desired material, said machine comprising a carriage, a cutter boom mounted on the carriage for up-and-down movement relative to the carriage, and a cutter carried by the boom adapted to cut down into a seam on lowering the boom, said apparatus comprising:

first electrical signal means constituting a slow-down signal means for signalling when the cutter has cut down into a seam generally to a predetermined depth short of the interface between the seam and the underlying stratum for slowing down the cutting rate as the cutter approaches the interface;

second electrical signal means constituting a stop signal means for signalling when the cutter has cut down through the seam to the interface for stopping the cutting operation, thereby to avoid mining undesired material with the desired material;

a cable adapted for connection to the boom;

means guiding the cable for movement lengthwise of the cable;

the cable being movable in one direction by the boom on movement of the boom in one direction and the apparatus having means for moving the cable in the opposite direction on movement of the boom in the opposite direction;

said first signal means comprising a first switch for generating the first signal;

said second signal means comprising a second switch for generating the second signal;

each switch having an actuator;

switch-operating means on the cable engageable with the switch actuators for actuating the first switch to generate the first signal when the cutter has cut down into the seam generally to said predetermined depth and for subsequently actuating the second switch to generate the second signal when the cutter has cut down through the seam to the interface;

means mounting the switches adjacent the cable with their actuators positioned for the successive actuation of the switches; and means for adjusting said switch-mounting means to adjust the position of the switch actuators relative to the switch-operating means on the cable to adjust the apparatus for different seam conditions.

16. Apparatus as set forth in claim 15 having a lamp of one color controlled by said first signal means and a lamp of a different color controlled by said second signal means visually to alert the operator of the mining machine to slow down the cutting rate generally when the cutter reaches said predetermined depth and to stop the cutting operation when the cutter has cut down through the seam to said interface.

17. Apparatus as set forth in claim 15 wherein the cable is movable in said one direction by the boom on lowering of the boom, and the means for moving the cable in the opposite direction comprises means for taking up the cable on raising of the boom.

18. Apparatus as set forth in claim 17 wherein the cable take-up means comprises spring steel tapes.

19. Apparatus as set forth in claim 15 having means for effecting slowing down of the rate of movement of the boom in response to a signal from the first signal means and for stopping the boom in response to a signal from the second signal means.

20. Apparatus as set forth in claim 19 having hydraulically powered means for moving the boom, means for delivering hydraulic fluid thereto, and solenoid valve means operable in response to a signal from said first signal means to reduce the delivery of hydraulic fluid to said hydraulically operated means for slowing down the rate of movement of said boom and operable in response to a signal from said second signal means to cut off delivery of hydraulic fluid to said hydraulically operated means to stop the boom.

21. Apparatus as set forth in claim 15 having means operable automatically in response to change in attitude of said apparatus for effecting relative adjustment of said switch mounting means and said switch-operating means to compensate for said change in attitude.

22. Apparatus as set forth in claim 15 wherein the means for guiding the cable comprises means for establishing a straight reach of the cable, said switch-operating means being on said reach, wherein the switch-mounting means comprises a support for the switches and means mounting the support for movement generally parallel to and alongside said reach, and wherein the adjusting means comprises means for adjusting said support along its said mounting means.

23. Apparatus as set forth in claim 15 having means operable automatically in response to sensing the interface for effecting relative adjustment of said switch-mounting means and said switch-operating means to compensate for said change in attitude.

24. In mining or excavating, the method of controlling a movable cutting element in the movement thereof to a seam interface at which the cutting element is to be stopped, comprising:

gauging the position of the cutting element relative to the interface as the cutting element moves toward said interface;

operating a slow-down signal when the movable cutting element has moved to a preliminary elevation short of said interface;

slowing down the cutting element upon operation of said slow-down signal, while continuing the gauging of the position of the cutting element relative to said interface;

operating a stop signal when the movable cutting element reaches said interface; and stopping the cutting element upon operation of said stop signal.

25. The method of claim 24 wherein the two signals are visual signals of different colors and an operator who is controlling the movement of the movable cutting element acts in response thereto to slow down and stop the movement.

26. The method of claim 24 wherein the slow-down signal acts to slow down the movement of the movable cutting element and the stop signal acts to stop it.

27. The method of claim 24 wherein the gauging is initially adjusted by moving the movable cutting element to the elevation of said interface, and the stop signal is set for operation at that elevation.

28. The method of controlling the mining by a mining machine of a seam of desired material, such as coal, overlying a stratum of undesired bottom material, such as clay, with reduction in the quantity of undesired material mined with the desired material, the machine comprising a cutter movable up and down and adapted to cut down into a seam of the desired material on being lowered, comprising:

gauging the depth of the cutter in the seam of the desired material as the cutter cuts down into the seam;

operating a first signal constituting a slow-down signal when the cutter has cut down into the seam of the desired material to a depth which is generally a predetermined distance from the interface between the seam of the desired material and the underlying stratum;

slowing down the cutting rate of the cutter in response to said slow-down signal while continuing the gauging of the depth of the cutter in said seam of the desired material;

operating a second signal constituting a stop signal when the cutter has cut down through the entire depth of the seam of the desired material to the interface;

and stopping the cutting operation in response to said stop signal, thereby to avoid mining the undesired bottom material with the desired material.

29. The method of claim 28 wherein the first and second signals are visual signals of different colors and the operator of the machine acts in response thereto to slow down and stop the cutting operation.

30. The method of claim 28 wherein the first signal acts to slow down the cutting rate and the second signal acts to stop the cutting operation.

31. The method of claim 28 wherein the gauging of the depth is initially adjusted generally by lowering the cutter into engagement with the exposed surface of said underlying stratum adjacent a face of the seam where a cutting operation is to be started, and setting the stop signal for operation at that position.

32. The method of claim 31 wherein the first and second signals are visual signals of different colors and the operator of the machine acts in response thereto to slow down and stop the cutting operation.

33. The method of claim 31 wherein the first signal acts to slow down the cutting rate and the second signal acts to stop the cutting operation.

34. The method of claim 28 or claim 31 further comprising adjusting the gauging of the depth on change of attitude of the mining machine.

35. The method of claim 28 or claim 31 further comprising adjusting the gauging of the depth by sensing the interface.

36. Apparatus for controlling the mining by a mining machine of a seam of desired material, such as coal, underlying a stratum of undesired material to reduce the quantity of the undesired material mined with the desired material, said machine comprising a carriage, a cutter boom mounted on the carriage for up-and-down movement relative to the carriage, and a cutter carried by the boom adapted to cut upwardly into a seam on raising the boom, said apparatus comprising:

first electrical signal means constituting a slow-down signal means for signalling when the cutter has cut upwardly into a seam generally to a predetermined distance short of the interface between the seam and the overlying stratum for slowing down the cutting rate as the cutter approaches the interface;

second electrical signal means constituting a stop signal means for signalling when the cutter has cut upwardly through the seam to the interface for stopping the cutting operation, thereby to avoid mining undesired material with the desired material;

a cable adapted for connection to the boom;

means guiding the cable for movement lengthwise of the cable;

the cable being movable in one direction by the boom on movement of the boom in one direction and the apparatus having means for moving the cable in the opposite direction on movement of the boom in the opposite direction;

said first signal means comprising a first switch for generating the first signal;

said second signal means comprising a second switch for generating the second signal;

each switch having an actuator;

switch-operating means on the cable engageable with the switch actuators for actuating the first switch to generate the first signal when the cutter has cut upwardly into the seam generally to said predetermined distance and for subsequently actuating the second switch to generate the second signal when the cutter has cut upwardly through the seam to the interface;

means mounting the switches adjacent the cable with their actuators positioned for the successive actuation of the switches; and means for adjusting said switch-mounting means to adjust the position of the switch actuators relative to the switch-operating means on the cable to adjust the apparatus for different seam conditions.

37. Apparatus as set forth in claim 36 having a lamp of one color controlled by said first signal means and a lamp of a different color controlled by said second signal means visually to alert the operator of the mining machine to slow down the cutting rate generally when the cutter reaches said predetermined distance and to stop the cutting operation when the cutter has cut upwardly through the seam to said interface.

38. Apparatus as set forth in claim 36 wherein the cable is movable in said one direction by the boom on lowering the boom, and the means for moving the cable in the opposite direction comprises means for taking up the cable on raising the boom.

39. Apparatus as set forth in claim 38 wherein the cable take-up means comprises spring steel tapes.

40. Apparatus as set forth in claim 36 having means for effecting slowing down of the rate of movement of the boom in response to a signal from the first signal means and for stopping the boom in response to a signal from the second signal means.

41. Apparatus as set forth in claim 40 having hydraulically powered means for moving the boom, means for delivering hydraulic fluid thereto, and solenoid valve means operable in response to a signal from said first signal means to reduce the delivery of hydraulic fluid to said hydraulically operated means for slowing down the rate of movement of said boom and operable in response to a signal from said second signal means to cut off delivery of hydraulic fluid to said hydraulically operated means to stop the boom.

42. Apparatus as set forth in claim 41 having variable-speed electric motor means for moving the cutting element and wherein the means for effecting the slowing down and stopping of the cutting element comprises means operable in response to a signal from said first signal generating means to slow down the motor means and operable in response to a signal from said second signal generating means to stop the motor means.

* * * * *